US006420080B1

(12) United States Patent
Nakamura et al.

(10) Patent No.: US 6,420,080 B1
(45) Date of Patent: Jul. 16, 2002

(54) PROCESS FOR FORMING IMAGE

(75) Inventors: Masaki Nakamura; Yoshifumi Iida; Daisuke Ishizuka, all of Minamiashigara (JP)

(73) Assignee: Fuji Xerox, Co., LTD, Tokyo (JP)

( * ) Notice: Subject to any disclaimer, the term of this patent is extended or adjusted under 35 U.S.C. 154(b) by 0 days.

(21) Appl. No.: 09/976,112

(22) Filed: Oct. 15, 2001

(30) Foreign Application Priority Data

Oct. 17, 2000 (JP) ..... 2000-316278

(51) Int. Cl.[7] ..... G03G 21/00
(52) U.S. Cl. ..... 430/125; 399/343
(58) Field of Search ..... 430/125; 399/343

(56) References Cited

U.S. PATENT DOCUMENTS 5,296,905 A * 3/1994 Yousey et al. ..... 399/350

FOREIGN PATENT DOCUMENTS

| | | |
|---|---|---|
| JP | B2 3-63757 | 10/1991 |
| JP | A 4-203784 | 7/1992 |
| JP | A 5-107950 | 4/1993 |
| JP | A 6-75495 | 3/1994 |
| JP | A 6-167902 | 6/1994 |
| JP | A 6-250557 | 9/1994 |
| JP | A 6-289746 | 10/1994 |

* cited by examiner

*Primary Examiner*—John Goodrow
(74) *Attorney, Agent, or Firm*—Oliff & Berridge, PLC

(57) ABSTRACT

A process for forming an image uses a transfer fixing process that can maintain high image quality for a long period of time. The process contains the steps of: transferring a toner image formed on the image bearing member to an intermediate transfer member; simultaneously transferring and fixing the toner image on the intermediate transfer member to a recording medium; the process containing a cleaning step of supplying and removing a cleaning material to the intermediate transfer member, so as to clean a surface of the intermediate transfer member, the cleaning material containing at least powder of a thermoplastic resin having a volume average particle diameter of about from 1 to 50 $\mu$m, and the cleaning material having a storage modulus of about from $1\times10^3$ to $1\times10^5$ Pa at a temperature, at which the cleaning material has a loss modulus of $1\times10^4$ Pa.

17 Claims, 2 Drawing Sheets

PROCESS FOR FORMING IMAGE

BACKGROUND OF THE INVENTION

1. Field of the Invention

The present invention relates to a process for forming an image using an electrophotographic process or an electrostatic recording process, in which an electrostatic latent image is developed and transferred to an intermediate transfer member, and an image is transferred and fixed to a recording medium by heating or the like procedure.

2. Description of Related Art

Various systems have been known as an electrophotographic process, such as a system disclosed in Japanese Patent Publication No. 23910/1967. In the electrophotographic process, a fixed image is formed in such a manner containing plural steps in that a latent image is electrically formed on a photoreceptor using a photoconductive substance by various methods, the latent image is developed by using a toner, the toner image on the photoreceptor is transferred to a transfer material, such as paper, through or not through an intermediate transfer member, and then the transferred image is fixed by application of heat, pressure, or heat and pressure, or by using a solvent vapor. The toner remaining on the photoreceptor is cleaned by various methods depending on necessity, and the plural steps are repeated.

Because the electrophotographic system using no organic solvent unlike ordinary printing, it is not restricted in setting environment, and because it is a simple system requiring no expert skill unlike ordinary printing, it is widely spread to office and home. Due to popularization and progress of computers and networks thereof caused with wide spread of sophisticated information-intensive society in recent years, there are increasing needs of on-demand printing of digital information, and further improvement in image quality of the electrophotographic system is demanded.

Among various types of the electrophotographic systems, those using a transferring and fixing process disclosed in Japanese Patent Publication No. 41679/1971. Japanese Patent Publication No. 63757/1991 and Japanese Patent Laid-Open No. 107950/1993 cause no disorder of a toner image upon transferring and thus are effective for improvement of image quality since the transferring step and the fixing step are simultaneously carried out.

However, because a toner image is newly formed on the intermediate transfer member after completion of the transferring and fixing step, followed by repeating the transferring and fixing step, toner-filming, such as a non-transferred toner after the transferring and fixing step, minute offset and paper powder, remains on the surface of the intermediate transfer member, which brings about such drawbacks that it adversely affects formation of the next toner image, it is offset on the next transfer material, and the releasing property of the intermediate transfer member is deteriorated to be liable to cause releasing failure of the transfer material.

In the systems where the transferring step and the fixing step are independently carried out, those disclosed in Japanese Patent Laid-Open No. 167902/1994 and Japanese Patent Laid-Open No. 250557/1994 are effective to maintain the surface of a fixing device clean owing to the functions including cleaning of the surface of the fixing device and application of a releasing oil. However, in the transferring and fixing process, the surface is necessarily maintained to a further clean state in comparison to the system where the transferring step and the fixing step are independently carried out since the transferring step is again conducted after the fixing step. Therefore, in the case where the system disclosed in Japanese Patent Laid-Open No. 167902/1994 is applied to the transfer fixing process, it is insufficient since such problems occur that toner-filming through the cleaning member occurs on the intermediate transfer member, and the releasing oil damages the transferred image.

Silicone rubber, fluorine rubber and a fluorine resin have been generally used as a material for the surface of the fixing device. As a method for preventing wear-out and deterioration of releasing property of the material of the surface of the fixing device, improving the cleaning property and improving the reliability, a method of application of a releasing oil is effective in any case, and the method has been used in the system where the transferring step and the fixing step are independently carried out.

Since silicone rubber originally contains a free silicone oil, toner components are liable to be deposited in the rubber when the heat fixing and printing are repeated without supply of a silicone oil, and the deposition can be prevented by supplying and coating the silicone oil.

Fluorine rubber has such an advantage, in comparison to the silicone rubber, that the wear resistance is high, but sufficient releasing property cannot be obtained unless a releasing film is formed by adsorbing or reacting a modified silicone on the fluorine rubber surface as disclosed in Japanese Patent Laid-Open No. 230784/1992.

In the case of the fluorine resin also, the reliability, such as prevention of sticking of the toner due to the presence of pinholes and prevention of wear-out of paper edges, can be remarkably improved by supplying silicone oil.

The method for coating the releasing material includes a donor roll system, a web system, a system using a roll wound with nonwoven cloth and a system using a roll having an oil added inside the roll, as disclosed in Japanese Patent Laid-Open No. 289746/1994 and Japanese Patent Laid-Open No. 75495/1994.

However, when these systems are applied to the transfer fixing process, the oil cannot be uniformly coated on the fixing surface unless the oil supplying amount is 1 $\mu$l or more per A-4 size paper. When the supplying amount is decreased, unevenness in oil supply, which is referred to as so-called oil stripes, is liable to occur, whereby the releasing material is attached to the intermediate transfer member to contaminate the image forming member such as a photoreceptor, or nonuniformity in cleaning occurs.

As described in the foregoing, it is difficult to improve the reliability of fixing in color duplicators and color printers using the transfer fixing process through the conventional technique having been disclosed, and at present, a process for forming an image using a newly designed transfer fixing process is being demanded.

SUMMARY OF THE INVENTION

The invention is developed to solve the problems associated with the conventional art and to provide a process for forming an image using a transfer fixing process that can maintain high image quality for a long period of time.

As a result of earnest investigations of adhesion property of the cleaning material made by the inventors with respect to the cleaning property of an intermediate transfer member for the transfer fixing process, it has been found that when a cleaning material having the specific viscoelastic characteristics is supplied to and removed from the intermediate transfer member, toner-filming on the intermediate transfer member is removed to maintain the surface of the intermediate transfer member clean, whereby high image quality of the transferred toner image and high quality of the fixed toner image can be maintained for a long period of time. Thus, the invention has been completed.

According to an aspect of the invention, the process for forming an image contains the steps of: forming a toner image on an image bearing member by developer; transferring a toner image formed on the image bearing member to an intermediate transfer member; simultaneously transferring and fixing the toner image on the intermediate transfer member to a recording medium; releasing the recording medium having the toner image fixed thereon from the intermediate transfer member; and cleaning a toner remaining on the intermediate transfer member using a cleaning material. The cleaning material contains thermoplastic resin particles having a volume average particle diameter of about from 1 to 50 $\mu$m and a storage modulus (G') of about from $1\times10^3$ to $1\times10^5$ Pa at a temperature Tmc, at which the cleaning material has a loss modulus (G") of $1\times10^4$ Pa.

According to another aspect of the invention, the apparatus for forming an image contains: a developing unit for forming a toner image on an image bearing member by developer; a transferring unit for transferring a toner image formed on the image bearing member onto an intermediate transfer member; a simultaneous transferring and fixing unit for simultaneously transferring and fixing the toner image on the intermediate transfer member onto a recording medium; a unit for releasing the recording medium having the toner image fixed thereon from the intermediate transfer member; and a unit for cleaning a toner remaining on the intermediate transfer member using a cleaning material. The cleaning material contains thermoplastic resin particles having a volume average particle diameter of about from 1 to 50 $\mu$m and a storage modulus (G') of about from $1\times10^3$ to $1\times10^5$ Pa at a temperature Tmc, at which the cleaning material has a loss modulus (G") of $1\times10^4$ Pa.

BRIEF DESCRIPTION OF THE DRAWINGS

Preferred embodiments of the invention will be described in detail based on the following figures, wherein.

DESCRIPTION OF THE PREFERRED EMBODIMENTS

Figure 1:
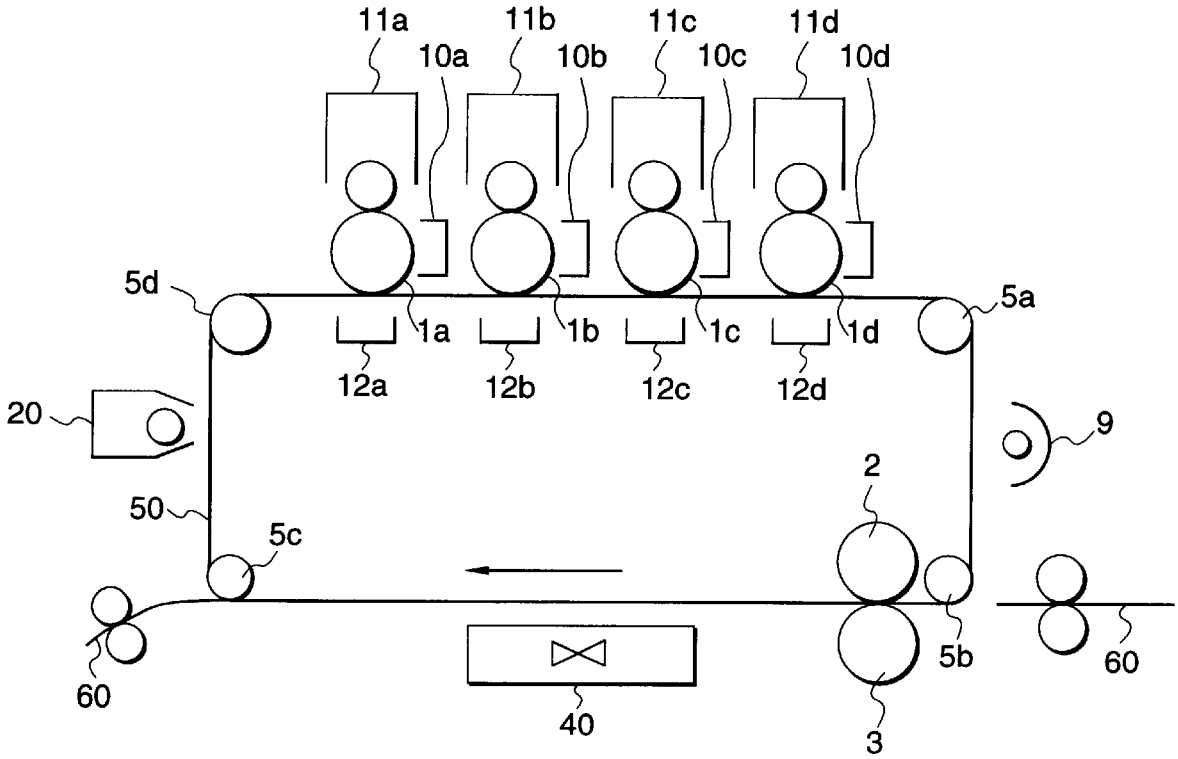
FIG. 1 is a schematic constitutional diagram showing one embodiment of an apparatus for forming an image that can be applied to the process for forming an image according to the invention.

The invention will be described in detail below.

The process for forming an image of the invention contains at least the transferring step, the simultaneous transferring and fixing step and the cleaning step, and depending on necessity, may contain other steps.

Cleaning Step

The cleaning step is to supply a cleaning material to the intermediate transfer member and then removing the cleaning material therefrom, whereby the surface of the intermediate transfer member is cleaned.

The cleaning material used in the cleaning step will be described.

The cleaning material contains at least thermoplastic resin particles having a volume average particle diameter of about from 1 to 50 $\mu$m, and further contains other components depending on necessity.

By using the thermoplastic resin as the main component of the cleaning material, the cleaning material is attached to the toner-filming on the intermediate transfer member by utilizing the sticking property thereof, and the cleaning material is released and recovered along with the toner-filming.

When the volume average particle diameter of the thermoplastic resin powder exceeds about 50 $\mu$m, spaces where the cleaning material is not attached are liable to be formed on the intermediate transfer member upon supplying the cleaning material thereto, so as to form spaces that cannot be cleaned. When the supply amount of the cleaning material is increased to bridge the spaces, the thickness of the cleaning material is increased, whereby the cleaning material is liable to be broken upon releasing. When the volume average particle diameter of the thermoplastic resin powder is less than about 1 $\mu$m, the flowability of the powder is deteriorated to cause unevenness upon supplying, whereby cleaning failure occurs.

The volume average particle diameter of the thermoplastic resin powder is preferably from 2 to 30 $\mu$m, and more preferably from 3 to 20 $\mu$m.

The volume average particle diameter of the thermoplastic resin powder in the invention is measured by using Coulter Multisizaer II, produced by Beckman Coulter, Inc.

The supply amount the cleaning material is preferably from 0.5 to 2.5 layers corresponding to the particle diameter of the cleaning material.

From the viewpoint of the attaching and releasing characteristics, the cleaning material necessarily has a storage modulus (G') of about from $1\times10^3$ to $1\times10^5$ Pa at a temperature Tmc, at which the cleaning material has a loss modulus (G") of $1\times10^4$ Pa. Preferably, the cleaning material has a storage modulus (G') of from $3\times10^3$ to $7\times10^4$ Pa, and more preferably from $5\times10^3$ to $5\times10^4$ Pa, at the temperature Tmc.

When the storage modulus (G') of the cleaning material at the temperature Tmc is less than about $1\times10^3$ Pa, the cleaning material is attached to the toner-filming but is liable to be broken upon releasing, and the cleaning material remains on the intermediate transfer member. When the storage modulus (G') of the cleaning material at the temperature Tmc exceeds about $1\times10^5$ Pa, the cleaning material is difficult to be attached to the toner-filming on the intermediate transfer member owing to the too high elasticity thereof, so as to cause insufficient cleaning.

The cleaning material used in the invention preferably satisfies the following viscoelastic characteristics. That is, at a temperature Tmt, at which the toner forming the toner image has a loss modulus (G") of $1\times10^4$ Pa, the cleaning material has a loss modulus (G") of about from $1\times10^3$ to $1\times10^5$ Pa and a storage modulus (G') of about from $1\times10^3$ to $1\times10^5$ Pa.

When the foregoing conditions are satisfied, the toner and the cleaning material used in the invention are rapidly attached to each other, so as to improve the cleaning property of the remaining toner of the transfer fixing step. The temperature upon cleaning is preferably from Tmt −20° C. to Tmt +20° C., and when the cleaning material has a storage modulus (G') at the temperature Tmt of less than about $1\times10^3$ Pa, the cleaning material is attached to the toner filming on the intermediate transfer member but is liable to be broken upon releasing, whereby the cleaning material sometimes remains on the intermediate transfer member. On the other hand, when the cleaning material has a storage modulus (G') at the temperature Tmt exceeding $1\times10^5$ Pa, the cleaning material is difficult to be attached to the toner filming on the intermediate transfer member owing to the too high elasticity thereof, so as to cause insufficient cleaning. When the cleaning material has a loss modulus (G") at the temperature Tmt of less than about $1\times10^3$ Pa, the cleaning material is similarly liable to be broken upon releasing, and when it exceeds about $1\times10^5$ Pa, the cleaning material is difficult to be attached to the toner filming on the intermediate transfer member, so as to cause insufficient cleaning.

The dynamic viscoelastic characteristics of the cleaning material and the toner used in the invention are measured in the following manner. Measurements are conducted by using a rheometer produced by Rheometric Scientific FE Co., Ltd. (RDA2, a trade name, RHIOS System Ver. 4.3) using parallel plates of a diameter of 8 mm under the conditions of a plate distance of 4 mm, a frequency of 1 rad/sec, a temperature increasing rate of 1° C. per minute, a measurement temperature range of from 40 to 150° C. and an automatic distortion rate control of 20% at maximum, on which the temperature Tmc, at which the loss modulus (G") of the cleaning material becomes $1\times10^4$ Pa, and the storage modulus (G') of the cleaning material at that temperature are measured, and the temperature Tmt, at which the loss modulus (G") of the toner becomes $1\times10^4$ Pa, and the loss modulus (G") and the storage modulus (G') of the cleaning material at that temperature are measured.

Examples of the thermoplastic resin used in the cleaning material include an ethylene series resin, such as polyethylene and polypropylene, a styrene series resin, such as polystyrene and α-polymethylstyrene, a (meth)acrylic series resin, such as polymethyl(meth)acrylate and polyacrylonitrile, a polyamide resin, a polycarbonate resin, a polyether resin, a polyester resin and a copolymer resin thereof, and a styrene series resin, a (meth)acrylic series resin, a styrene-(meth)acrylic series copolymer resin and a polyester resin are preferred from the standpoint of the melting temperature range upon using as the cleaning material.

The thermoplastic resin may be either an amorphous resin or a crystalline resin as far as it satisfies the dynamic viscoelastic characteristics of the invention.

Monomer components constituting the thermoplastic resin will be described.

Examples of a vinyl monomer include an olefinic compound, such as ethylene and propylene; examples of a styrene series monomer include styrene, α-methylstyrene, vinylnaphthalene, an alkyl-substituted styrene with an alkyl chain, such as 2-methylstyrene, 3-methylstyrene, 4-methylstyrene, 2-ethylstyrene, 3-ethylstyrene and 4-ethylstyrene, a halogen-substituted styrene, such as 2-chlorostyrene, 3-chlorostyrene and 4-chlorostyrene, and a fluorine-substituted styrene, such as 4-fluorostyrene and 2,5-difluorostyrene; and examples of a (meth)acrylic series monomer include (meth)acrylic acid, methyl (meth)acrylate, ethyl (meth)acrylate, n-propyl (meth)acrylate, n-butyl (meth)acrylate, n-pentyl (meth)acrylate, n-hexyl (meth) acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, iso-propyl (meth)acrylate, iso-butyl (meth)acrylate, tert-butyl (meth) acrylate, iso-pentyl (meth)acrylate, amyl (meth)acrylate, neo-pentyl (meth)acrylate, iso-hexyl (meth)acrylate, iso-heptyl (meth)acrylate, iso-octyl (meth)acrylate, 2-ethylhexyl (meth)acrylate, phenyl (meth)acrylate, biphenyl (meth)acrylate, diphenylethyl (meth)acrylate, tert-butylphenyl (meth)acrylate, terphenyl (meth)acrylate, cyclohexyl (meth)acrylate, tert-butylcyclohe xyl (meth) acrylate , dimethylaminoethyl (meth)acrylate, diethylaminoethyl (meth)acrylate, methoxyethyl (meth)acrylate, 2-hydroxyethyl (meth)acrylate, (meth)acrylonitrile and (meth)acrylamide.

Additionally, examples of a vinyl monomer component having crosslinking property include a diene compound, such as isoprene and butadiene, an aromatic divinyl compound (for example, divinyl benzene and divinyl naphthalene), a diacrylate compound bonded with an alkyl chain (for example, ethylene glycol diacrylate, 1,3-butylene glycol diacrylate, 1,4-butanediol diacrylate, 1,5-pentanediol diacrylate, 1,6-hexanediol diacrylate, neopentylglycol diacrylate and those compounds having methacrylate groups instead of the acrylate groups), a diacrylate compound bonded with an alkyl chain containing an ether bond (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate and those compounds having methacrylate groups instead of the acrylate groups), and a diacrylate compound bonded with a chain containing an aromatic group and an ether bond (for example, polyoxyethylene(2)-2,2-bis(4-hydroxyphenyl)propane diacrylate, polyoxyethylene(4)-2,2-bis(4-hydroxyphenyl) propane diacrylate and those compounds having methacrylate groups instead of the acrylate groups). Preferred examples of a polyfunctional crosslinking agent include pentaerythritol triacrylate, trimethylolmethane triacrylate, trimethylolpropane triacrylate, tetramethylolmethane tetraacrylate, oligoester acrylate and those compounds having methacrylate groups instead of the acrylate groups. Among these monomers, (meth)acrylic acid, 2-hydroxyethyl (meth)acrylate, acrylamide and the like, which have a carboxyl group, a hydroxyl group and an amide group, sometimes form ultrafine particles by themselves owing to high solubility in an aqueous medium when the continuous phase is an aqueous medium. In such cases, it is preferred that the bind of a diffusing agent or emulsifier is selected, or these monomers solely or as a mixture with other monomers are preliminary polymerized to have a molecular weight of less than several thousands before using.

The polyester resin can be synthesized from an arbitrary combination of the following monomer components by the known processes disclosed, for example, in *Jushukugo* (Polycondensation) published by Kagaku-Dojin Publishing Co., Ltd., *Kobunshi Jikkengaku, Jushukugo to Jufuka* (Polymer Experimentals, Polycondensation and Polyaddition) published by Kyoritsu Shuppan Co., Ltd., and *Polyester Jusi Handbook* (Polyester Resin Handbook) edited by The Nikkan Kogyo Shinbun, Ltd., and the ester exchanging process and the direct polycondensation process can be employed solely or in combination thereof. The monomers are not particularly limited, and the known monomers disclosed in *Kobunshi Data Handbook, Kiso-hen* (Polymer Data Handbook, Basics) edited by Polymer Society Japan published by Baifukan Co., Ltd. can be used solely or in combination thereof.

Examples of the monomer component constituting the polyester resin include a divalent or three or more valent carboxylic acid and a divalent or three or more valent alcohol that have been known.

Examples of the divalent carboxylic acid include a dibasic acid, such as succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid and mesaconic acid, an anhydride thereof, a lower alkyl ester thereof, and an aliphatic unsaturated dicarboxylic acid, such as maleic acid, fumaric acid, itaconic acid and citraconic acid. Examples of the three or more valent carboxylic acid include 1,2,4-benzenetricarboxylic acid, 1,2,5-benzenetricarboxylic acid, 1,2,4-naphthalenetricarboxylic acid, an anhydride thereof, and a lower alkyl ester thereof. These may be used singly or combination of two or more of them.

Examples of the divalent alcohol include bisphenol A, hydrogenated bisphenol A, an ethylene oxide and/or propylene oxide adduct of bisphenol A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol and neopentyl glycol. Examples of the three or more valent alcohol include glycerin, trimethyolethane, trimethylolpropane and pentaerythritol. These may be used singly or in combination of two or more of them. A monovalent acid, such as acetic acid and benzoic acid, and a monovalent alcohol, such as cyclohexanol and benzyl alcohol, may be used for adjusting the acid value and the hydroxyl value depending on neccessity.

The cleaning material may substantially contain a tetrahydrofuran-insoluble (hereinafter abbreviated as THF-insoluble) component irrespective to a styrene series, an acrylic series and a polyester series, as far as it satisfies the dynamic viscoelastic characteristics of the invention. The THF-insoluble component can be measured in such a manner that the resin is dissolved in THF to a concentration of about 10% by weight, which is filtered by a membrane filter, and the component remaining on the filter is dried and weighed.

The glass transition temperature (hereinafter abbreviated as Tg) of the thermoplastic resin is preferably in a range of from 40 to 100° C. The Tg can be measured, for example, by using a differential calorimeter (hereinafter abbreviated as DSC) (DSC 3110. Thermal Analysis System 001, produced by MAC Science Co., Ltd.) under the condition of a temperature increasing rate of 5° C. per minute, and the temperature at the shoulder on the low temperature side of the endothermic point corresponding to the Tg in the resulting chart is designated as the Tg.

With respect to the molecular weight of the thermoplastic resin, as far as it is in the range satisfying the dynamic viscoelastic characteristics of the invention, the weight average molecular weight (hereinafter abbreviated as Mw) is preferably from 30,000 to 300,000, and more preferably from 35,000 to 200,000, and the number average molecular weight (hereinafter abbreviated as Mn) is preferably from 2,000 to 30,000, and more preferably from 2,500 to 20,000, for the styrene series resin, the (meth)acrylic series resin and the styrene-(meth)acrylate copolymer resin. For the polyester resin, the Mw is preferably from 10,000 to 150,000, and more preferably from 12,000 to 120,000, and the Mn is preferably from 4,000 to 10,000, and more preferably from 4,500 to 8,000.

The molecular weight and the molecular weight distribution can be measured by the known method, and it is generally measured by gel permeation chromatography (hereinafter abbreviated as GPC). The GPC measurement can be conducted by using HLC-802A, produced by Tosoh Corp., as a GPC apparatus under the conditions of an oven temperature of 40° C., a column flow amount of 1 ml per minute, and a sample injection amount of 0.1 ml, with a sample concentration of 0.5% and the use of THF for GPC produced by Wako Pure Chemical Industries, Ltd. The calibration curve can be prepared by using the standard polystyrene samples produced by Tosoh Corp. The molecular weights and the molecular weight distributions in the invention are measured by the foregoing manner.

The cleaning material is preferably supplied to the intermediate transfer member after charging and developing as similar to the electrophotographic developer.

The cleaning material may be in the form of a one-component electrophotographic developer or in the form of a two-component electrophotographic developer used with a carrier.

In the case of the form of a two-component electrophotographic developer, the carrier is not particularly limited, and known carriers, such as a resin-coated carrier, can be preferably used. The resin-coated carrier is formed by coating a resin on a core material. Examples of the core material include powder having magnetism, such as iron powder, ferrite powder and nickel powder. Examples of the resin include a fluorine series resin, a vinyl polymer and a silicone polymer.

The cleaning material is preferably improved in performance, such as charging property and the powder flowability, by containing a charge controlling material, inorganic fine particles and organic fine particles, as similar to the electrophotographic toner. Furthermore, the cleaning material may contain an additive that is appropriately selected depending on purpose. For example, an iron series material, e.g., iron, ferrite and magnetite, and a metal and an alloy exhibiting ferromagnetism, such as nickel and cobalt, as well as a compound, a magnetic material and a material capable of being magnetized containing the metal may be added to obtain magnetism.

Examples of the inorganic fine particles include silica, alumina, titanium oxide, barium titanate, magnesium titanate, calcium titanate, strontium titanate, zinc oxide, silica sand, clay, mica, sand-lime, diatom earth, cerium chloride, red iron oxide, chromium oxide, cerium oxide, antimony trioxide, magnesium oxide, zirconium oxide, silicon carbide and silicon nitride. Among these, titanium series fine particles and silica series fine particles are preferred, and fine particles having been subjected to a hydrophobic treatment are preferred. The inorganic fine particles are used generally for improving the flowability. The primary particle diameter of the inorganic fine particles is preferably from 1 to 1,000 nm, and the addition amount thereof is preferably from 0.01 to 20% by weight based on the total weight of the cleaning material.

Examples of the organic fine particles include polystyrene, polymethylmethacrylate and polyvinylidene fluoride. Those fine particles having a surface treated with a silicone series compound or a fluorine series compound are also preferably used. The organic fine particles are used generally for improving the cleaning property and the transferring property.

The addition amount of the organic fine particles is preferably from 0.01 to 20% by weight based on the total weight of the cleaning material.

Examples of the charge controlling material include a metallic salt of salicylic acid, a metal-containing azo compound, nigrosine and a quaternary ammonium salt. The charge controlling material is used generally for improving the charging property.

The addition amount of the charge controlling material is preferably from 0.01 to 10% by weight based on the total weight of the cleaning material.

The cleaning material may contain a releasing material to improve the cleaning property of the intermediate transfer member. Examples of the releasing material used in the invention include paraffin wax, such as low molecular weight polypropylene and low molecular weight polyethylene, a silicone resin, a rosin compound, rice wax and carnauba wax. Among these, one having a melting point of from 40 to 150° C. is preferred, and one having a melting point of from 70 to 110° C. is more preferred. The addition amount of the wax is preferably 20% by weight or less based on the total weight of the cleaning material because when the addition amount of the wax is too large, the cleaning property is adversely deteriorated.

It is effective for the cleaning property that the thermoplastic resin contained in the cleaning material has a composition of the same kind as the toner used for forming an image. For example, in the case of a toner using a polyester resin, the cleaning material preferably contains a polyester resin, and in the case of a toner containing a styrene-acrylic resin, the cleaning material preferably contains a styrene-acrylic resin.

The cleaning material used in the invention can be produced by the kneading and pulverization process and the wet process, which have been known.

The methods for supplying and removing the cleaning material will be described.

In the process for forming an image according to the invention, the supply and removal of the cleaning material are preferably carried out between the step of releasing a recording medium having a toner image fixed thereon from an intermediate transfer member and the step of transferring a next toner image on the intermediate transfer member.

The method for supplying the cleaning material is not particularly limited, as far as the cleaning material can be supplied to the surface of the intermediate transfer member, and a method for supplying the cleaning material to the intermediate transfer member by using an electrostatic coating method is preferably employed.

That is, as similar to an electrophotographic toner, such a method is simple and effective that the cleaning material is charged in a developing device and supplied to the intermediate transfer member by using an electrostatic coating method. Therefore, in order to improve the coated state, the technique of addition of fine particles as an external additive used for a toner can be applied to the cleaning material, so as to improve the powder characteristics and the charging characteristics.

As the method for removing the cleaning material, any method of a method using a cleaning roll and a method using a cleaning blade can be employed.

In the invention, it is preferred that the cleaning material is heated and melted to adhere to toner-filming, such as a toner remaining after transferring, paper powder or a coating material of coated paper as a transfer material, stuck on the intermediate transfer member, and then the cleaning material is released along with the toner-filming components from the intermediate transfer material, whereby the surface of the intermediate transfer member is cleaned.

In the invention, while the cleaning step may be carried out once per one printing operation, because of superior cleaning property, the surface of the intermediate transfer member can be satisfactorily maintained clean only by such a frequency that the cleaning step is carried out once per from 100 to 500 printing operations, at which toner-filming on the intermediate transfer member is accumulated to cause adverse effects, by combining with an ordinary cleaner.

In the cleaning step in the invention, it is further preferred that a liquid releasing material is coated on the intermediate transfer member before supplying the cleaning material, in order to improve the cleaning property to obtain further high reliability.

After uniformly coating a liquid releasing material in an amount of from 1 to 10 mg per A-4 size, the cleaning material is supplied to clean the surface of the intermediate transfer member and, at the same time, to absorb the liquid releasing material into the cleaning material, and then the cleaning material is released and recovered. According to the procedures, a uniform releasing material film of an ultramicro amount that substantially causes no adverse affect to the image forming step can be formed on the surface of the intermediate transfer member, and toner-filming on the intermediate transfer member can be easily cleaned by the lubricating effect of the liquid releasing agent, whereby the surface of the intermediate transfer member can be maintained further clean.

The liquid releasing agent is not particularly limited as far as it does not cause problems, such as toner scatter inside the apparatus, and a heat resistant oil, such as a silicone oil, is preferred, with a modified silicone oil, such as a dimethylsilicone oil and an amino-modified silicone oil, being more preferably used. In the case where the surface material of the intermediate transfer member is fluorine rubber, a modified silicone oil having high adhesive property is particularly preferably used.

The silicone oil preferably has a viscosity of from 50 to 10,000 cs. When the viscosity is less than 50 cs, it is liable to evaporate to contaminate the interior of the apparatus, and when it exceeds 10,000 cs, it is difficult to be coated to fail to attain uniform application to the intermediate transfer member.

Examples of the method for coating the liquid releasing material include a donor roll system, a web system, a system using a roll wound with nonwoven cloth and a system using a roll having an oil added inside the roll, which have been well-known, as disclosed in Japanese Patent Laid-Open No. 289746/1994 and Japanese Patent Laid-Open No. 75495/1994. In these coating methods of directly coating, it is preferred that the coating operation is carried out depending on necessity by providing a retracting mechanism.

Transferring Step

The transferring step is a step of transferring the toner image formed on the image bearing member to the intermediate transfer member, and a known process can be utilized therefor.

Examples of the image bearing member include various known inorganic photoreceptor, such as Se, a-Si, a-SiC and CdS, and other various organic photoreceptors.

Any layer constitution can be employed for the intermediate transfer member, and examples thereof include a two-layer structure containing a base layer and a surface layer. Examples of the base layer include a polymer sheet having high heat resistance having a thickness of from 10 to 300 $\mu$m, such as a polymer sheet of polyester, polyethylene terephthalate, polyether sulfone, polyether ketone, polysulfone, polyimide, polyimideamide and polyamide. An electroconductive agent, such as carbon black, may be added to the base layer. In order to transfer the toner image from the image bearing member to the intermediate transfer member without of disorder of an image by an electrostatic manner, it is preferred that the volume resistivity of the base layer is adjusted to a range of from $10^{13}$ to $10^{15}$ $\Omega$·cm by changing the addition amount of the electroconductive agent, such as carbon black.

In order to transfer the toner image from the image bearing member to the intermediate transfer member without disorder of the image by an electrostatic manner, the surface layer is preferably adjusted to have a volume resistivity of from $10^{13}$ to $10^{15}$ Ω·cm. It is preferred that the surface layer contains a material selected from fluorine rubber, a fluorine resin and silicone rubber from the standpoint of releasing property and heat resistance. Among these, silicone rubber is optimum as the material of the surface layer because silicone rubber has elasticity and exhibits adhesion property on the surface thereof to the toner at ordinary temperature, and further it has such characteristics that the molten and fluidized toner is liable to be released from the surface, whereby the toner image can be effectively transferred to the recording medium. The surface layer preferably has a thickness of from 1 to 100 μm and has high releasing property, and examples thereof include a resin, such as a tetrafluoroethylene-perfluoroalkyl vinyl ether copolymer and polytetrafluoroethylene, and fluorine rubber, such as a hexafluoropropene-vinylidene fluoride copolymer.

Simultaneous Transferring and Fixing Step

The simultaneous transferring and fixing step is a step of transferring and fixing the toner image on the intermediate transfer member to the recording medium, and a known process can be utilized therefor.

A transferring and fixing device used in this step may have any constitution, as far as it can uniformly heat the toner image and uniformly apply pressure thereto causing no lifting nor deviation between the intermediate transfer member and the recording medium. For example, a constitution having a pair of heat and pressure rolls, a constitution having one roll and one fixed pad, and a constitution having a pair of fixed pads may be employed.

Examples of the heat and pressure roll include a metallic roll having a heat resistant elastic layer, such as silicone rubber, coated thereon. A heating source, such as a halogen lamp, can be arranged inside the heat and pressure roll.

One embodiment of the process for forming an image according to the invention will be described with reference to the drawings. FIG. 1 is a schematic constitutional diagram showing one embodiment of an apparatus for forming an image that can be applied to the process for forming an image according to the invention.

In the apparatus for forming an image shown in FIG. 1, photoreceptors (image bearing members) 1*a*, 1*b*, 1*c* and 1*d* are arranged on an outer circumferential surface of an intermediate transfer member 50. Charging devices 10*a*, 10*b*, 10*c* and 10*d* and developing devices 11*a*, 11*b*, 11*c* and 11*d* containing toners of black, yellow, magenta and cyan colors, respectively, are arranged around the photoreceptors 1*a*, 1*b*, 1*c* and 1*d*, respectively. Transferring devices 12*a*, 12*b*, 12*c* and 12*d* are arranged to face the photoreceptors 1*a*, 1*b*, 1*c* and 1*d*, respectively, via the intermediate transfer member 50. A pair of heat and pressure rolls 2 and 3 is arranged to face each other via the intermediate transfer member 50. A heating device 9 is arranged near the outer circumferential surface of the intermediate transfer member 50 on the upstream side of the pair of heat and pressure rolls 2 and 3, and a cooling device 40 is arranged near the outer circumferential surface of the intermediate transfer member 50 on the downstream side. The intermediate transfer member 50 is hung by supporting rolls 5*a*, 5*b*, 5*c* and 5*d*. A cleaning material supplying device 20 is provided between the supporting roll 5*c* and the supporting roll 5*d*.

In the apparatus for forming an image shown in FIG. 1, the four photoreceptors 1*a*, 1*b*, 1*c* and 1*d* arranged on the outer circumferential surface of the intermediate transfer member 50 are uniformly charged by the charging devices 10*a*, 10*b*, 10*c* and 10*d*, respectively, and then exposed by a light scanning device (not shown in the figure), so as to form electrostatic latent images. The electrostatic latent images on the photoreceptors are respectively developed by the developing devices 11*a*, 11*b*, 11*c* and 11*d* containing toners of black, yellow, magenta and cyan colors, respectively, so as to form toner images of the respective colors are formed on the photoreceptors. The toner images of the respective colors are successively transferred to the intermediate transfer member 50 by the transferring devices 12*a*, 12*b*, 12*c* and 12*d*, so as to form a toner image having plural colors on the intermediate transfer member 50.

The toner image formed on the intermediate transfer member 50 is heated and melted by a heater 9. The heat and pressure roll 3 is in contact under pressure with the heat and pressure roll 2 associated with supply of paper (recording medium) 60. The toner image of plural colors maintained on the intermediate transfer member 50 is compressed under the condition that the image is sandwiched by the intermediate transfer member 50 and the paper 60 by pressing onto the heat and pressure roll 3 by the intermediate transfer member 50, and then the image is further compressed and heated by passing the intermediate transfer member 50 and the paper 60 between the heat and pressure roll 2 and the heat and pressure roll 3. The intermediate transfer member 50 and the paper 60 in one united form transported from the heating region are cooled by the cooling device 40. The intermediate transfer member 50 and the paper 60 cooled by the cooling device 40 are further transported, and the paper 60 is released with the toner image from the intermediate transfer member 50 at the supporting roll 5*c* owing to the stiffness of the paper 60 itself, so as to form a color image of the fixed toner images on the paper 60. The surface of the toner image transferred and fixed on the paper 60 is smoothed by the surface of the intermediate transfer member 50 to have high gloss.

The surface of the intermediate transfer member 50, from which the paper 60 has been released, is cleaned by a cleaning material supplied from the cleaning material supplying device 20.

Figure 2:
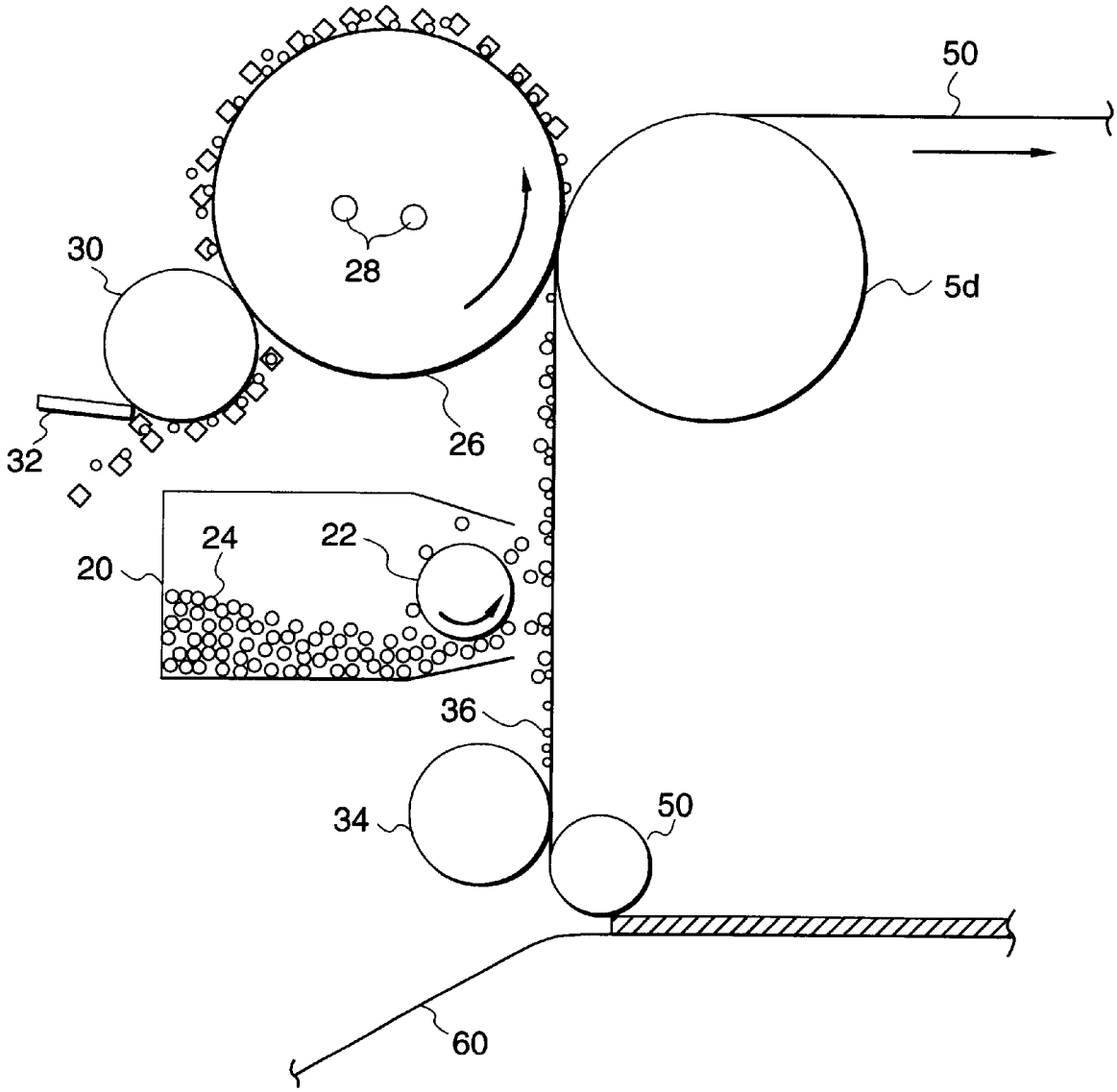
FIG. 2 is a schematic diagram showing one embodiment of a cleaning step in the process for forming an image according to the invention.

FIG. 2 is a schematic diagram showing one embodiment of the cleaning step in the process for forming an image according to the invention.

A liquid releasing material 36 is coated on the intermediate transfer member 50, from which the paper 60 has been released, by a releasing material coating device 34. Subsequently, a cleaning material 24 is supplied from the cleaning material supplying device 20 arranged on the upstream side of the releasing material coating device 34, and then the cleaning material 24 and the liquid releasing material 36 on the intermediate transfer member 50 are removed by a first cleaning roll 26 provided on the upstream side of the cleaning material supplying device 20, so as to clean the surface of the intermediate transfer member 50.

The cleaning material supplying device 20 shown in FIG. 2 has a cleaning material supplying roll 22. When the cleaning material supplying roll 22 is rotated in an arrow direction in the drawing, the cleaning material 24 in the cleaning material supplying device 20 is scooped up by the cleaning material supplying roll 22, and the cleaning material 24 is supplied to the intermediate transfer member 50 at the position on the cleaning material supplying roll 22 facing the intermediate transfer member 50. At this time, it is preferred that the cleaning material 24 is imparted with electric charge of one polarity by friction charging and is supplied to the intermediate transfer member 50 by the electrostatic coating method. The constitution of the cleaning material supplying roll 22 is not particularly limited, and for example, such a constitution can be exemplified that a coating layer is formed on a cylindrical substrate. It is preferred that the coating layer is formed with a binder resin containing electroconductive fine particles dispersed therein.

In FIG. 2, the first cleaning roll 26 and the supporting roll 5*d* are arranged to face each other via the intermediate transfer member 50. Heating lamps 28 are provided inside the first cleaning roll 26 to heat the surface of the first cleaning roll 26. The cleaning material 24 on the intermediate transfer member 50 thus transported is heated and melted by heat on the surface of the first cleaning roll 26 to be released from the intermediate transfer member 50 and attached to the first cleaning roll 26. The cleaning material 24 containing the toner-filming components attached to the surface of the first cleaning roll 26 is removed by a blade 32 through a second cleaning roll 30. The embodiment using the cleaning rolls is described with reference to FIG. 2, but the invention is not limited thereto.

The embodiment using sponge as the releasing material coating device 34 is described with reference to FIG. 2, but the invention is not limited thereto, and a roll wound with nonwoven cloth and a donor roll can be employed as noted in the foregoing.

EXAMPLE

The invention will be further described in more detail with reference to the following examples, but the invention is not construed as being limited to the examples. In the following description, all the "parts" mean "parts by weight".

Production of Cleaning Material

Synthesis Example 1 of Polyester Resin

In a reaction vessel having an agitator, a thermometer, a condenser and a nitrogen gas inlet tube, 145.5 parts of terephthalic acid, 46.8 parts of dodecenylsuccinic acid, 25.2 parts of trimellitic acid, 113.5 parts of bisphenol A 2 mol-ethylene oxide adduct, 260.6 parts of bisphenol A 2 mol-propylene oxide adduct, 4.34 parts of ethylene glycol and 3.0 parts of dibutyl tin oxide as a catalyst are placed, and after replacing the interior of the reaction vessel with a dry nitrogen gas, reaction is carried out under agitation at about 200° C. for about 5 hours under a nitrogen gas stream, and reaction is further carried out under agitation at a temperature increased to about 240° C. for about 3 hours, so as to obtain an amorphous polyester resin of a transparent pale yellow color. The amorphous polyester resin is designated as PES 1. PES1 has a weight average molecular weight of about 88,900 and a number average molecular weight of about 5,100 measured by GPC of the polystyrene standard and a glass transition temperature of 69.9° C. measured by a DSC method.

Synthesis Example 2 of Polyester Resin

An amorphous polyester resin PES2 of a transparent pale yellow color is obtained in the same manner as in Synthesis Example 1 of Polyester Resin except that the reaction is carried out under agitation at about 200° C. for about 7 hours and further carried out at a temperature increased to about 240° C. for about 10 hours instead of the reaction in Synthesis Example 1 carried out under agitation at about 200° C. for about 5 hours under a nitrogen gas stream and further carried out under agitation at a temperature increased to about 240° C. for about 3 hours. PES2 has a weight average molecular weight of about 110,000 and a number average molecular weight of about 6,500 measured by GPC of the polystyrene standard and a glass transition temperature of 69.9° C. measured by a DSC method.

Synthesis Example 3 of Polyester Resin

In a reaction vessel having an agitator, a thermometer, a condenser and a nitrogen gas inlet tube, 116.4 parts of terephthalic acid, 77.6 parts of isophthalic acid, 211.3 parts of bisphenol A 2 mol-ethylene oxide adduct, 24.1 parts of ethylene glycol and 2.0 parts of dibutyl tin oxide as a catalyst are placed, and after replacing the interior of the reaction vessel with a dry nitrogen gas, reaction is carried out under agitation at about 200° C. for about 5 hours under a nitrogen gas stream, and reaction is further carried out under agitation at a temperature increased to about 240° C. for about 3 hours, so as to obtain a transparent colorless amorphous polyester resin. The amorphous polyester resin is designated as PES3. PES3 has a weight average molecular weight of about 9,500 and a number average molecular weight of about 3,900 measured by GPC of the polystyrene standard and a glass transition temperature of 65.1° C. measured by a DSC method.

Synthesis Example 4 of Polyester Resin

In a reaction vessel having an agitator, a thermometer, a condenser and a nitrogen gas inlet tube, 145.5 parts of terephthalic acid, 46.8 parts of dodecenylsuccinic acid, 50.4 parts of trimellitic acid, 260.6 parts of bisphenol A 2 mol-ethylene oxide adduct, 4.34 parts of ethylene glycol and 3.0 parts of dibutyl tin oxide as a catalyst are placed, and after replacing the interior of the reaction vessel with a dry nitrogen gas, reaction is carried out under agitation at about 200° C. for about 5 hours under a nitrogen gas stream, and reaction is further carried out under agitation at a temperature increased to about 240° C. for about 3 hours, so as to obtain a transparent colorless amorphous polyester resin. The amorphous polyester resin is designated as PES4. PES4 has a weight average molecular weight of about 160,000, a number average molecular weight of about 5,600 and a gel fraction of 35% measured by GPC of the polystyrene standard and a glass transition temperature of 65.1° C. measured by a DSC method.

Synthesis Example 1 of Styrene-Acrylate Copolymer

After replacing an interior of an autoclave with a dry nitrogen gas, 265.2 parts of a styrene monomer and 57.6 parts of a n-butyl acrylate monomer are placed therein. The temperature thereof is increased to 120° C. at a rate of 5° C. per 10 minutes, followed by reacting at that temperature for about 5 hours, and the temperature is then further increased to 180° C. at a rate of 2° C. per 10 minutes, followed by reacting at that temperature for about 2 hours, so as to obtain a transparent colorless amorphous styrene-acrylate copolymer resin STA1. STA1 has a weight average molecular weight of about 63,300 and a number average molecular weight of about 26,600 measured in the same manner as in Synthesis Example 1 of Polyester Resin and a glass transition temperature of 65.0° C. measured by a DSC method.

Production of Cleaning Material

PES1 obtained in Synthesis Example 1 of Polyester Resin is pulverized to fine particles by using a pulverizer, Type IDS2, and classified by an Elbow Jet Classifier, so as to obtain thermoplastic resin powder having a volume average particle diameter $d_{50}$ of 15 $\mu$m. Hydrophobic silica fine powder (RX50, produced by Nippon Aerosil Co., Ltd.) is added thereto to a content of 2% by weight based on the total weight of the cleaning material, so as to obtain a cleaning material C1. Cleaning materials C2, C3, C4, C5 and C6 are produced in the same manner by using the compositions shown in Table 1 below. The mixing operation of the thermoplastic resin and the releasing material is carried out by using a Banbury mixer. The measurement method of dynamic viscoelastic characteristics of the resulting cleaning materials C1 to C6 and toners described later is conducted in the manner described in the foregoing. The characteristics of the cleaning materials C1 to C6 are shown in Table 1 below.

distribution of the toner is measured by Coulter Counter TA-II, produced by Beckman Coulter, Inc. 2 parts of hydrophobic silica fine particles (RX50, produced by Nippon Aerosil Co., Ltd.) are externally added to 100 parts of the resulting toner by using a Henschel mixer to produce an externally added toner.

A magenta toner, a yellow toner and a black toner are produced in the same manner except that the coloring agent is replaced from the cyan pigment (C.I. Pigment Blue 15:3) to a magenta pigment (C.I. Pigment Red 57:1), a yellow pigment (C.I. Pigment Yellow 17) and carbon black, respectively, so as to obtain a full-color toner of four colors.

TABLE 1

| | Composition | | Glass transition | Dynamic viscoelastic characteristics of cleaning material | | | | | Particle diameter |
|---|---|---|---|---|---|---|---|---|---|
| Cleaning material | Thermoplastic resin | Releasing material | tempera-ture Tg (° C.) | Tmc (° C.) | G' at Tmc (Pa) | Tmt (° C.) | G" at Tmt (Pa) | G' at Tmt (Pa) | of resin (μm) |
| C1 | PES1 (100%) | none | 67 | 112 | 4,000 | 108 | 18,000 | 8,000 | 15 |
| C2 | PES2 (100%) | none | 66 | 125 | 7,000 | | 70,000 | 60,000 | 10 |
| C3 | STA1 (95%) | Poly-ethylene wax (5%) | 65 | 122 | 3,000 | | 50,000 | 30,000 | 8 |
| C4 | PES2 (97%) | Carnauba wax (3%) | 66 | 124.5 | 6,900 | | 70,000 | 60,000 | 12 |
| C5 | PES3 (100%) | none | 67 | 100 | 600 | | 4,000 | 100 | 10 |
| C6 | PES4 (96%) | Carnauba wax (4%) | 65 | 108 | 150,000 | | 10,000 | 30,000 | 15 |

Composition of Additive: 2% by weight of hydrophobic silica fine powder (RX50, produced by Nippon Aerosil Co., Ltd.) based on the total weight of the cleaning material

Production of Toner

Synthesis of Binder Resin A

In a reaction vessel having an agitator, a thermometer, a condenser and a nitrogen gas inlet tube, 116.4 parts of terephthalic acid, 77.6 parts of isophthalic acid, 211.3 parts of bisphenol A 2 mol-ethylene oxide adduct, 93 parts of ethylene glycol and 2.0 parts of dibutyl tin oxide as a catalyst are placed, and after replacing the interior of the reaction vessel with a dry nitrogen gas, reaction is carried out under agitation at about 200° C. for about 15 hours under a nitrogen gas stream, so as to obtain a transparent amorphous polyester resin of a pale yellow color, which has a weight average molecular weight of about 26,000 and a number average molecular weight of about 5,700 measured by GPC of the polystyrene standard and a glass transition temperature of 63° C. measured by a DSC method so as to obtain binder resin A.

Production of Toner

Binder Resin A 100 parts

Cyan pigment (C.I. Pigment Blue 15:3) 4.5 parts

Paraffin wax (melting point: 89° C.) 3 parts

The foregoing components are mixed and melted under kneading at a rotation number of 120 rpm for about 15 minutes by using a BR type Banbury mixer (produced by Kobe Steel, Ltd.). The kneaded product is formed into a plate form having a thickness of about 1 cm with calender rollers and then coarsely pulverized to several millimeters by a Fitzmill type pulverizer. The coarsely pulverized product is then successively subjected to fine pulverization by an IDS type pulverizer and classification by an Elbow type classifier, so as to obtain a cyan toner having a volume average particle diameter of 6.5 μm. The particle size

EXAMPLES 1 TO 5 AND COMPARATIVE EXAMPLES 1 TO 3

In Examples 1 to 5 and Comparative Examples 2 to 3, formation of images is carried out by using a modified machine of Docucolor 4040, produced by Fuji Xerox Co., Ltd., having the cleaning material supplying device and the intermediate transferring and fixing device shown in FIG. 2 installed. In Comparative Example 1, formation of images is carried out by using no cleaning material supplying device provided. Upon formation of images, a mixture of 8 parts of the externally added toner of respective colors obtained in the foregoing and 100 parts of a carrier is used. The carrier is of a resin coated type, which is obtained by coating a ferrite core with a mixture of an amino group-containing vinyl polymer and a fluorinated alkyl group-containing vinyl polymer.

In the cleaning step, a mixture of 8 parts of the respective cleaning material and 100 parts of a carrier is used. The carrier used herein is the same as the carrier added to the externally added toner.

The mixture of the cleaning material and the carrier is placed in the cleaning material supplying device 20 shown in FIG. 2, and cleaning is conducted at an interval shown in Table 2. The cleaning material is removed by using a cleaning roll having the constitution shown in FIG. 2.

Table 2 below shows, in Examples and Comparatives, the system of the releasing material coating device, the kind and the supply amount of the releasing material, the system of the cleaning material supplying device, the kind of the cleaning material used, the material of the surface layer of the intermediate transfer member, the interval of supply of the cleaning material, and the amount of the releasing material remaining on the surface of the intermediate transfer member after cleaning.

TABLE 2

| | Coating of releasing material | | | Supply of cleaning material | | | Interval of | Amount of releasing |
|---|---|---|---|---|---|---|---|---|
| | Device | Releasing material | Supply amount to intermediate transfer material | Device | Cleaning material | Surface material of intermediate transfer member | cleaning by coating releasing material | material on intermediate transfer member after cleaning |
| Example 1 | none | none | none | two-component non-contact development | C1 C1 | Silicone rubber 40 ° C. | per 500 prints | none |
| Example 2 | Roll having retracting mechanism with oil internally added | Amino-modified silicone oil 300 cs | 2 mg per A-4 paper | " | C2 | Fluorine rubber | " | 0.05 mg per A-4 paper |
| Example 3 | Donor roll having retracting mechanism | Dimethyl silicone oil 200 cs | 3 mg per A-4 paper | " | C1 | Silicone rubber 40° C. | " | 0.05 mg per A-4 paper |
| Example 4 | none | none | none | " | C3 | " | per 300 prints | none |
| Example 5 | none | none | none | " | C4 | " | " | none |
| Comparative Example 1 | none | none | none | none | none | " | none | none |
| Comparative Example 2 | none | none | none | two-component non-contact development | C5 | " | per 500 prints | none |
| Comparative Example 3 | none | none | none | " | C6 | " | " | none |

Evaluation of Cleaning Property

In order to evaluate the cleaning property, the surface of the intermediate transfer member is evaluated. The following measurements are conducted per 1,000 prints of 50,000 prints in total. (1) Evaluation is carried out with the naked eye to confirm coloring on the surface of the intermediate transfer member caused by the toner. (2) The degree of gloss (hereinafter abbreviated as gloss) of the surface of the intermediate transfer member is measured by using a gloss-meter "GM-26D" produced by Murakami Color Research Laboratories, Inc. under conditions of an incident light angle on the sample of 75°.

The results of evaluation of the cleaning property are shown in Table 3 below.

It is understood from the results shown in Table 3 that in the process for forming an image according to the invention of Examples 1 to 5 having the cleaning step, in which the cleaning material specified in the invention is supplied to and removed from the intermediate transfer member to clean the surface of the intermediate transfer member, the problem of coloring due to the toner on the surface of the intermediate transfer member is not severe, the gloss of the surface of the intermediate transfer member is excellent, and no defect on image quality of prints occurs for a long period of time.

According to the invention, a process for forming an image using a transfer fixing process that can maintain high image quality for a long period of time can be provided.

TABLE 3

| | Coloring caused by toner on surface of intermediate transfer member | | Gloss of surface of intermediate transfer member | | Defect on image quality of print |
|---|---|---|---|---|---|
| Example 1 | A | No coloring until 50,000 prints | B | Reduction in gloss 5 | none |
| Example 2 | B | Coloring on 30,000 prints | B | Reduction in gloss 10 | none |
| Example 3 | C | Coloring on 20,000 prints | B | Reduction in gloss 15 | nonc |
| Example 4 | B | Coloring on 30,000 prints | B | Reduction in gloss 10 | none |
| Example 5 | B | Coloring on 30,000 prints | B | Reduction in gloss 10 | none |
| Comparative Example 1 | D | Coloring on 1000 prints | D | Reduction in gloss 70 | Occurrence of offset |
| Comparative Example 2 | D | Coloring on 500 prints | D | Reduction in gloss 70 | Occurrence of offset and occurrence of offset of cleaning material in initial stage |
| Comparative Example 3 | D | Coloring on 2000 prints | D | Reduction in gloss 70 | Occurrence of offset |

Note:
A: excellent
B: very good
C: good
D: poor

The entire disclosure of Japanese Patent Application No. 2000-316278 filed on Oct. 17, 2000 including specification, claims, drawings and abstract is incorporated herein by reference in its entirety.

What is claimed is:

1. A process for forming an image, comprising the steps of: forming a toner image on an image bearing member by developer; transferring the toner image formed on the image bearing member to an intermediate transfer member; simultaneously transferring and fixing the toner image on the intermediate transfer member onto a recording medium; releasing the recording medium having the toner image fixed thereon from the intermediate transfer member; and cleaning a toner remaining on the intermediate transfer member using a cleaning material, the cleaning material containing thermoplastic resin particles having a volume average particle diameter of about from 1 to 50 $\mu$m, and the cleaning material having a storage modulus (G') of about from $1\times10^3$ to $1\times10^5$ Pa at a temperature Tmc, at which the cleaning material has a loss modulus (G") of $1\times10^4$ Pa.

2. The process for forming an image as claimed in claim 1, wherein the cleaning material having a storage modulus (G') of about from $1\times10^3$ to $1\times10^5$ Pa and a loss modulus (G") of about from $1\times10^3$ to $1\times10^5$ Pa at a temperature Tmt, at which the toner has a loss modulus (G") of $1\times10^4$ Pa.

3. The process for forming an image as claimed in claim 1, wherein the cleaning is carried out between the releasing of the recording medium having the toner image fixed thereon from the intermediate transfer member and the forming of a next toner image on the intermediate transfer member.

4. The process for forming an image as claimed in claim 1, wherein the thermoplastic resin particles have a volume average particle diameter of about from 2 to 30 $\mu$m.

5. The process for forming an image as claimed in claim 1, wherein the cleaning material amount is from 0.5 to 2.5 layers, which is supplied on the surface of the intermediate transfer member.

6. The process for forming an image as claimed in claim 1, wherein the cleaning is carried out at a temperature of from Tmt −20° C. to Tmt +20° C., where Tmt is a temperature, at which the toner has a loss modulus (G") of $1\times10^4$ Pa.

7. The process for forming an image as claimed in claim 1, wherein the cleaning is carried out by heating and melting after coating the cleaning material by an electrostatic coating method.

8. The process for forming an image as claimed in claim 1, wherein the thermoplastic resin is selected from polyester and a vinyl polymer.

9. The process for forming an image as claimed in claim 1, wherein the cleaning material contains a releasing material.

10. The process for forming an image as claimed in claim 1, wherein the cleaning contains coating of a liquid releasing material on the intermediate transfer member before supplying the cleaning material to the intermediate transfer member.

11. The process for forming an image as claimed in claim 10, wherein the liquid releasing material is a modified silicone oil.

12. The process for forming an image as claimed in claim 1, wherein the intermediate transfer member has a surface layer containing a material selected from fluorine rubber, a fluorine resin and silicone rubber.

13. An apparatus for forming an image, comprising: a developing unit that forms a toner image on an image bearing member by developer; a transferring unit that transfers the toner image formed on the image bearing member onto an intermediate transfer member; a simultaneous transferring and fixing unit that simultaneously transfers and fixes the toner image on the intermediate transfer member onto a recording medium; a unit that releases the recording medium having the toner image fixed thereon from the intermediate transfer member; and a unit that cleans a toner remaining on the intermediate transfer member using a cleaning material, the cleaning material containing thermoplastic resin particles having a volume average particle diameter of about from 1 to 50 $\mu$m, and the cleaning material having a storage modulus (G') of about from $1\times10^3$ to $1\times10^5$ Pa at a temperature Tmc, at which the cleaning material has a loss modulus (G") of $1\times10^4$ Pa.

14. The apparatus for forming an image as claimed in claim 13, wherein the cleaning material has a storage modulus (G") of about from $1\times10^3$ to $1\times10^5$ Pa and a loss modulus (G') of about from $1\times10^3$ to $1\times10^5$ Pa at a temperature Tmt, at which the toner has a loss modulus (G") of $1\times10^4$ Pa.

15. The apparatus for forming an image as claimed in claim 13, wherein the thermoplastic resin particles have a volume average particle diameter of about from 2 to 30 $\mu$m.

16. The apparatus for forming an image as claimed in claim 13, wherein the cleaning material amount is from 0.5 to 2.5 layers, which is supplied on the surface of the intermediate transfer member.

17. The apparatus for forming an image as claimed in claim 13, wherein the intermediate transfer member has a surface layer containing a material selected from fluorine rubber, a fluorine resin and silicone rubber.

* * * * *